US008827065B2

(12) United States Patent
Enenkel

(10) Patent No.: US 8,827,065 B2
(45) Date of Patent: Sep. 9, 2014

(54) METHOD AND APPARATUS FOR TRANSPORTING ARTICLES IN A PLURALITY OF PARALLEL BUFFER SECTIONS

(75) Inventor: Peter Enenkel, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 111 days.

(21) Appl. No.: 13/218,488

(22) Filed: Aug. 26, 2011

(65) Prior Publication Data

US 2012/0048680 A1 Mar. 1, 2012

(30) Foreign Application Priority Data

Aug. 26, 2010 (DE) ..... 10 2010 035 472

(51) Int. Cl.
*B65G 47/46* (2006.01)
*B07C 5/00* (2006.01)

(52) U.S. Cl.
USPC ..... 198/349; 700/223; 209/900

(58) Field of Classification Search
CPC ..... B65G 47/46; B07C 5/00
USPC ..... 198/602, 347.1, 349
See application file for complete search history.

(56) References Cited

U.S. PATENT DOCUMENTS

| | | | | |
|---|---|---|---|---|
| 3,633,733 | A | 1/1972 | Rehr | |
| 5,158,183 | A | 10/1992 | Beerman et al. | |
| 5,577,596 | A * | 11/1996 | Van Essen | 198/349 |
| 5,730,270 | A | 3/1998 | Malow | |
| 6,107,579 | A | 8/2000 | Kinnemann | |
| 6,533,271 | B1 | 3/2003 | Zimmermann | |
| 6,878,896 | B2 * | 4/2005 | Esslinger et al. | 209/583 |
| 6,978,192 | B2 * | 12/2005 | Wisniewski | 700/224 |
| 7,624,854 | B2 * | 12/2009 | Zimmermann et al. | 198/347.1 |
| 7,982,156 | B2 * | 7/2011 | Burns et al. | 209/584 |
| 8,261,917 | B2 * | 9/2012 | Enenkel et al. | 209/659 |
| 2002/0104782 | A1 * | 8/2002 | DeWitt et al. | 209/3.3 |
| 2004/0065526 | A1 * | 4/2004 | Zeitler | 198/460.1 |
| 2008/0000814 | A1 * | 1/2008 | Zimmermann | 209/509 |
| 2008/0308386 | A1 | 12/2008 | Balk | |
| 2009/0102908 | A1 | 4/2009 | Imoto | |
| 2010/0332020 | A1 * | 12/2010 | Kechel | 700/214 |
| 2011/0046775 | A1 * | 2/2011 | Bailey et al. | 700/224 |

FOREIGN PATENT DOCUMENTS

| | | | |
|---|---|---|---|
| CA | 2408673 | C | 2/2010 |
| DE | 103 12 695 | A1 | 10/2004 |
| DE | 60109595 | T2 | 1/2006 |
| EP | 0 429 118 | A1 | 5/1991 |
| EP | 0706494 | B1 | 3/1998 |
| EP | 1133444 | B1 | 7/2002 |

* cited by examiner

*Primary Examiner* — Ramya Burgess
*Assistant Examiner* — Thomas Randazzo
(74) *Attorney, Agent, or Firm* — Laurence A. Greenberg; Werner H. Stemer; Ralph E. Locher

(57) ABSTRACT

An apparatus and a method transport articles by way of a plurality of parallel buffer sections. A feeding device transports the articles to a buffer device at a predetermined feeding speed. Each article is then directed into in each case one buffer section, which is either in a feeding mode or in a transporting-away mode. Each buffer section transports the articles which have been directed into this buffer section to a transporting-away device. In the feeding mode, the buffer section transports to the transporting-away device at a feeding buffer speed which depends on the feeding speed. In the transporting-away mode, the buffer section transports to the transporting-away device at a transporting-away buffer speed which depends on the transporting-away speed. The transporting-away device transports the articles away at a predetermined transporting-away speed.

17 Claims, 2 Drawing Sheets

METHOD AND APPARATUS FOR TRANSPORTING ARTICLES IN A PLURALITY OF PARALLEL BUFFER SECTIONS

CROSS-REFERENCE TO RELATED APPLICATION

This application claims the priority, under 35 U.S.C. §119, of German patent application DE 10 2010 035 472.4, filed Aug. 26, 2010; the prior application is herewith incorporated by reference in its entirety.

BACKGROUND OF THE INVENTION

Field of the Invention

The invention relates to an apparatus and a method for transporting articles by way of a plurality of parallel buffer sections.

An apparatus of the generic type and a method of the generic type are known from United States patent application publication US 2008/0308386 A1. Patent application publication US 2008/0308386 A1 describes an apparatus and a method for transporting articles. A "supplying conveyor S" feeds articles to four parallel "accumulating conveyors 1A to 1D". These "accumulating conveyors 1A to 1D" describe a loop. Arranged upstream of the "accumulating conveyors 1A to 1D" is a "diverter 4", which distributes articles to the "accumulating conveyors 1A to 1D". The "diverter" is connected to the four "supplying places 2A to 2D" of the four "accumulating conveyors 1A to 1D". The "supplying places 2A to 2D" are—as seen in the transport direction—arranged at the start of the "accumulating conveyors 1A to 1D". Located at the end of the "accumulating conveyors 1A to 1D" are four "discharging places 3A to 3D", which are all connected to a "merging member 5". The "merging member 5" receives articles from the "discharging places 3A to 3D" and transports these articles to a "discharging conveyor D".

The "diverter 4" transports articles at a "supplying speed V_in", the "merging member 5" at a "discharging speed V_out". Both speeds are variable over time, cf. FIG. 2A to FIG. 2F. A sensor is able to detect articles on the "supplying conveyor S". Furthermore, use can be made of a sensor which detects articles at a "discharging place".

FIG. 2A shows a situation in which the "accumulating conveyor 1A" is filled at a "supplying speed (V_in)". The "discharging speed (V_out)" is equal to zero. FIG. 2B shows a situation in which the "discharging speed (V_out)" is equal to the "supplying speed (V_in)". Articles are transported from the "diverter 4" to the "merging member 5" via an "accumulating conveyor 1A". FIG. 2C shows a situation in which the "discharging speed (V_out)" is less than the "supplying speed (V_in)". Articles are transported into the "accumulating conveyor 1B" by the "diverter 4" and fill the "accumulating conveyor 1B". In FIG. 2D, the "accumulating conveyor 1A" is emptied, the "accumulating conveyor 1B" is filled further. FIG. 2E shows that the completely filled "accumulating conveyor 1B" cannot yet be emptied because first of all the "accumulating conveyor 1A" has to be emptied. Therefore, the "accumulating conveyor 1B" is stopped. The "diverter 4" routes additional arriving articles into the "accumulating conveyor 10".

United States patent application publication US 2009/0102908 A1 describes a transporting apparatus having a plurality of parallel transporting sections. This transporting apparatus is employed for example in a printer or copier and transports sheets of paper. Flat articles are transported, with each flat article being temporarily clamped between two endless conveying belts, which are guided around rollers having horizontal axes of rotation. The articles transported are distributed onto the transporting paths. The transporting path is operated optionally in the "normal mode" or in the "standby mode", specifically depending on properties of an article in the transporting path and on environmental conditions. In the "standby mode", the article remains for a predetermined period of time in the transporting path, for example in order that an imprint on the article can dry.

United States patent application publication US 2008/0000814 A1 (commonly assigned) describes an arrangement having three parallel storage modules. A feeding device transports flat and upright items of mail on a feeding transporting path to the storage modules. Three feeding paths to the three storage modules branch off from this feeding transporting path. In each storage module, a respective stack of flat items of mail is formed. An additional item of mail is transported on the feeding path to the stack and is removed from this stack again in the opposite direction, specifically on the "last in—first out" (LIFO) principle. Each storage module is operated optionally

- with an "infeed function", in which further items of mail are fed to the stack,
- with an "extraction function", in which items of mail are removed from the stack, or
- with a "halt function," in which the storage module is deactivated.

U.S. Pat. No. 6,107,579 (commonly assigned) describes an apparatus which weighs items of mail while the items of mail are being transported. A feeding device transports items of mail into a branching device. This branching device distributes the items of mail to a plurality of parallel transporting paths. In each transporting path there are weighing scales, which weigh the items of mail transported in this transporting path. All the transporting paths open into the same transporting-away device. The effect of this arrangement is that the items of mail are transported without slipping and yet the weighing does not reduce the throughput, even though each individual set of weighing scales has a smaller throughput than the feeding device and the transporting-away device.

U.S. Pat. No. 5,577,596 describes an apparatus which distributes articles to a plurality of outputs. Such an apparatus can be used, for example, to sort items of mail. In the exemplary embodiment, the sorting installation has four inputs ("input stations") and many sorting outputs ("output positions"). The inputs and outputs are connected via a multiplicity of transporting units. Each transporting unit is fitted on a turntable and as a result mounted in a rotatable manner about a vertical axis of rotation. Furthermore, each transporting unit comprises two endless conveying belts, which are able to clamp an upright item of mail between one another. A transporting unit is able to transfer an item of mail to a subsequent transporting unit. Because the transporting units are mounted in a rotatable manner, in each case at least one transporting path can be produced from each input to each output.

U.S. Pat. No. 3,633,733 describes a transporting apparatus having a feeding device and a plurality of parallel transporting paths. A classifier classifies the fed articles, for example by color. A branching device ("diverter") distributes fed articles onto the transporting paths, specifically independently of the respective result that the classifier provides.

U.S. Pat. No. 5,158,183 and its counterpart European patent EP 429 118 B1 describe a buffer device which connects a feeding device to a transporting-away device. The buffer device comprises a plurality of parallel buffer modules, for example storage pockets for flat items of mail. For example, the buffer device comprises twelve buffer modules, which are arranged in a matrix-like arrangement in three rows of in each case four buffer modules. Monitoring takes place of when which article is passed into which buffer module and is removed from the latter again.

German published patent application DE 10312695 A1 describes a device and a method for conveying and storing conveyed articles. The device has for example 14 parallel storage paths 1, an inlet 2 to these storage paths 1 and an outlet 10 from these storage paths. The inlet 2 and the outlet 10 can be actuated and driven independently of one another. During normal operation, the inlet 2 and the outlet 10 are driven at the same speed. If a fault occurs downstream of the outlet 10, the outlet 10 is deactivated. Articles which continue to arrive are first of all routed into the first storage path 1 and stored there until it is filled, then in the second storage path 1, and so on. Once the fault has been resolved, first of all the first storage path 1 is emptied via the outlet 10, then the second storage path 1, and so on.

The foregoing publications and documents are herewith incorporated by reference in their entirety.

SUMMARY OF THE INVENTION

It is accordingly an object of the invention to provide a method and an apparatus for transporting articles in a plurality of parallel buffer sections which overcome the above-mentioned disadvantages of the heretofore-known devices and methods of this general type and which make it possible to largely decouple the supply of articles at the feeding speed from the transporting-away of the articles at the transporting-away speed.

With the foregoing and other objects in view there is provided, in accordance with the invention, an apparatus for transporting articles, comprising:

a feeding device, a buffer device having a branching device and at least two buffer sections; and a transporting-away device;

wherein:

each of the buffer sections connects the feeding device to the transporting-away device, the feeding device is configured to transport the articles to the buffer device, and the transporting-away device is configured to transport the articles away at a predetermined transporting-away speed;

the branching device is configured to direct each article received at the buffer device into a respective one of the buffer sections, and the buffer sections are configured to transport each respective article to the transporting-away device;

the feeding device is configured to transport the articles at a predetermined feeding speed and the transporting-away device is configured to transport the articles away at a predetermined transporting-away speed.

The apparatus further includes a regulator connected to and configured to actuate the branching device and the buffer sections such that each buffer section is in at least one of the following modes:

a feeding mode of the buffer section, wherein the branching device directs an article transported to the buffer device into the buffer section and the buffer section transports each article in the buffer section to the transporting-away device at a feeding buffer speed that depends on the feeding speed;

a transporting-away mode of the buffer section, wherein the buffer section transports each article in the buffer section to the transporting-away device at a transporting-away buffer speed that depends on the transporting-away speed; and the regulator is further configured to actuate each buffer section such that:

each buffer section is at any one time in at most one of the feeding and transporting away modes or in a third mode;

there is a gap present between an article that is farthest forward, in the transport direction, in the buffer section and the transporting-away device while the buffer section is in the feeding mode; and the regulator switching the buffer section into another mode in such a way that the buffer section is in the other mode before the article that is farthest forward reaches the transporting-away device.

In other words, the invention relates to an apparatus and a method for transporting articles by means of a plurality of parallel buffer sections. A feeding device transports the articles to the buffer device at a predetermined feeding speed. Each article transported to the buffer device is directed into in each case one buffer section. Each buffer section is at any one time either in a feeding mode or in a transporting-away mode or in a third mode, but never both in the feeding mode and in the transporting-away mode.

Each buffer section transports the articles, which have been directed into this buffer section, to a transporting-away device. In the feeding mode, the buffer section transports to the transporting-away device at a feeding buffer speed which depends on the feeding speed. In the transporting-away mode, the buffer section transports to the transporting-away device at a transporting-away buffer speed which depends on the transporting-away speed. The transporting-away device transports the articles away at a predetermined transporting-away speed.

A buffer section which is in the feeding mode transports the articles to the transporting-away device. During this transport, there is a gap between the furthest forward article in the buffer section and the transporting-away device. This gap becomes smaller and smaller. Before the furthest forward article in the buffer section reaches the transporting-away device, the buffer section is switched into the transporting-away mode or into a third mode. The effect of this switching is that no further articles are transported into the buffer section, that is to say no articles are fed.

The apparatus according to the solution and the method according to the solution make it possible to largely decouple the feeding speed and its temporal profile from the transporting-away speed and its temporal profile. This is achieved above all in that the apparatus comprises two buffer sections and each buffer section is either in the feeding mode or in the transporting-away mode at any one time, but not in both modes at the same time. One buffer section can be filled with articles from the feeding device while the other buffer section is being emptied by articles being passed into the transporting-away device. Each buffer section can be operated either in the transporting-away mode or in the feeding mode.

Thanks to the invention, it is not necessary for a buffer section to transport an article at the feeding buffer speed and a further article at the transporting-away buffer speed at the same time. This would bring about dependency between the feeding speed of the feeding device and the transporting-away speed of the transporting-away device.

The invention ensures that at any one time either articles are fed into a buffer section or articles are transported away from this buffer section and leave the buffer section.

The buffer device is able to compensate for fluctuations over time in the supply of articles, so that, in spite of fluctuating supply quantities, the transporting-away device achieves a uniform throughput.

Frequently, the distance between the feeding device and the transporting-away device can only be increased up to a predetermined limit, for example because there is no more space available. In order to increase the capacity of the buffer device, at least one additional buffer section can be provided, even by retroactive installation.

The apparatus according to the solution removes the necessity of arranging a plurality of buffer sections in succession or of providing a buffer section with a circular segment in order to manage with the available space.

The apparatus according to the solution makes it possible to transport a uniform stream of articles to an upstream processing device, that is to say a largely uniform supply rate to the processing device is achieved, specifically independently of the temporal profile of the quantity of articles on or in the feeding device.

The apparatus according to the solution makes it possible to decouple the feeding speed from the transporting-away speed, it being possible for the two speeds to be variable over time. This is made possible without it being necessary to alter the spacing between two articles in a buffer section. Articles in the buffer section can overlap one another partially or completely.

The apparatus according to the solution does not require articles to be stacked in order to buffer-store them. Such a stack requires that the articles have to be separated out again, and this entails the risk of double withdrawals. According to the solution, the articles are instead always transported in the same direction without the articles being stacked.

The invention removes the necessity of having to specify in advance a control method according to which the articles are distributed to the buffer sections. Instead, the articles can be distributed in a manner dependent on the temporally variable supply of further articles and also on the transporting away of the articles on the buffer sections. Each buffer section can be switched from one mode into another mode on the basis of these two variables.

It can never be ruled out that a jam or some other fault will occur in the buffer device. In one configuration, three buffer sections are provided. In this configuration, the buffer device can continue to be operated even in the event of a fault. The faulty buffer section is switched to a standstill mode and one of the two remaining buffer sections is operated in the feeding mode and the third in the transporting-away mode.

Preferably, when a first buffer section is currently in the transporting-away mode, the branching device directs articles into a second buffer section which is currently in the feeding mode. This makes it possible for the first buffer section to be emptied at a transporting speed which depends on the transporting-away speed and not on the feeding speed. At the same time, the second buffer section is filled at a transporting speed which depends on the feeding speed and not on the transporting-away speed.

Preferably, at any one time, precisely one buffer section is in the feeding mode or is being switched into the feeding mode, and precisely one buffer section is in the transporting-away mode or is being switched into the transporting-away mode.

Preferably, a buffer section is switched from the feeding mode into the transporting-away mode when the buffer section has transported the articles in the buffer section so far toward the transporting-away device that the gap between the furthest forward article and the transporting-away device has fallen below a predetermined limit, that is to say is controlled by events. As a result, the branching device has to be switched as rarely as possible.

Preferably, a buffer section remains in the transporting-away mode until it has been completely emptied, and is only switched into the feeding mode once emptying is complete. As a result, the buffer section can be switched when there are no articles in the buffer section, and so the buffer section does not need to transport any articles with a jump in speed.

Preferably, the buffer sections transport the articles such that during transport in the buffer section each article is gripped by a conveying device of the buffer section at any one time. As a result, the location of any article at any time can be predicted when a location of the article at one time and also the respective transporting speed of the buffer section are known.

Preferably, at least one buffer section, preferably even each buffer section, can be operated in the feeding mode, in the transporting-away mode or in a standstill mode and can be switched into each of these three modes. In the standstill mode, the transporting speed of this buffer section is equal to zero. It is possible for at least one article to be temporarily buffer-stored in the buffer section while this buffer section is in the standstill mode. It is also possible for the buffer section to be empty and for example to be serviced or repaired.

In a development, a filling-level sensor continuously monitors the current filling level of the transporting-away device. If this filling level reaches or exceeds a predetermined filling-level limit, a filled signal is generated, specifically either by the sensor or by the regulator. A buffer section which is currently in the feeding mode and in which the gap in front of the furthest forward article has reached the gap limit is either switched directly into the transporting-away mode or is first of all switched into the standstill mode. The buffer section is then switched into the standstill mode when a filled signal has been generated, and is otherwise switched directly into the transporting-away mode. The buffer section switched into the standstill mode temporarily buffer-stores articles and is switched from the standstill mode into the transporting-away mode as soon as the filled signal is no longer present because the filling level of the transporting-away device has dropped below the filling-level limit.

The apparatus according to the solution and the method according to the solution can be used for transporting separate articles, for example items of mail, packaged or unpackaged foodstuffs, empty containers, workpieces, replacement parts, pieces of luggage or pieces of freight.

Other features which are considered as characteristic for the invention are set forth in the appended claims.

Although the invention is illustrated and described herein as embodied in a method and apparatus for transporting articles in a plurality of parallel buffer sections, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the exemplary embodiment, the invention is used to transport flat items of mail (standard letters, large letters, postcards, catalogs, etc.). These items of mail are tipped in a disorderly manner onto a conveying belt. The conveying belt transports the items of mail to an aligning apparatus. This aligning apparatus rotates each item of mail through 90 degrees into a vertical position. For example, the aligning apparatus comprises rotated conveying belts and/or a directing plate.

Figure 1:
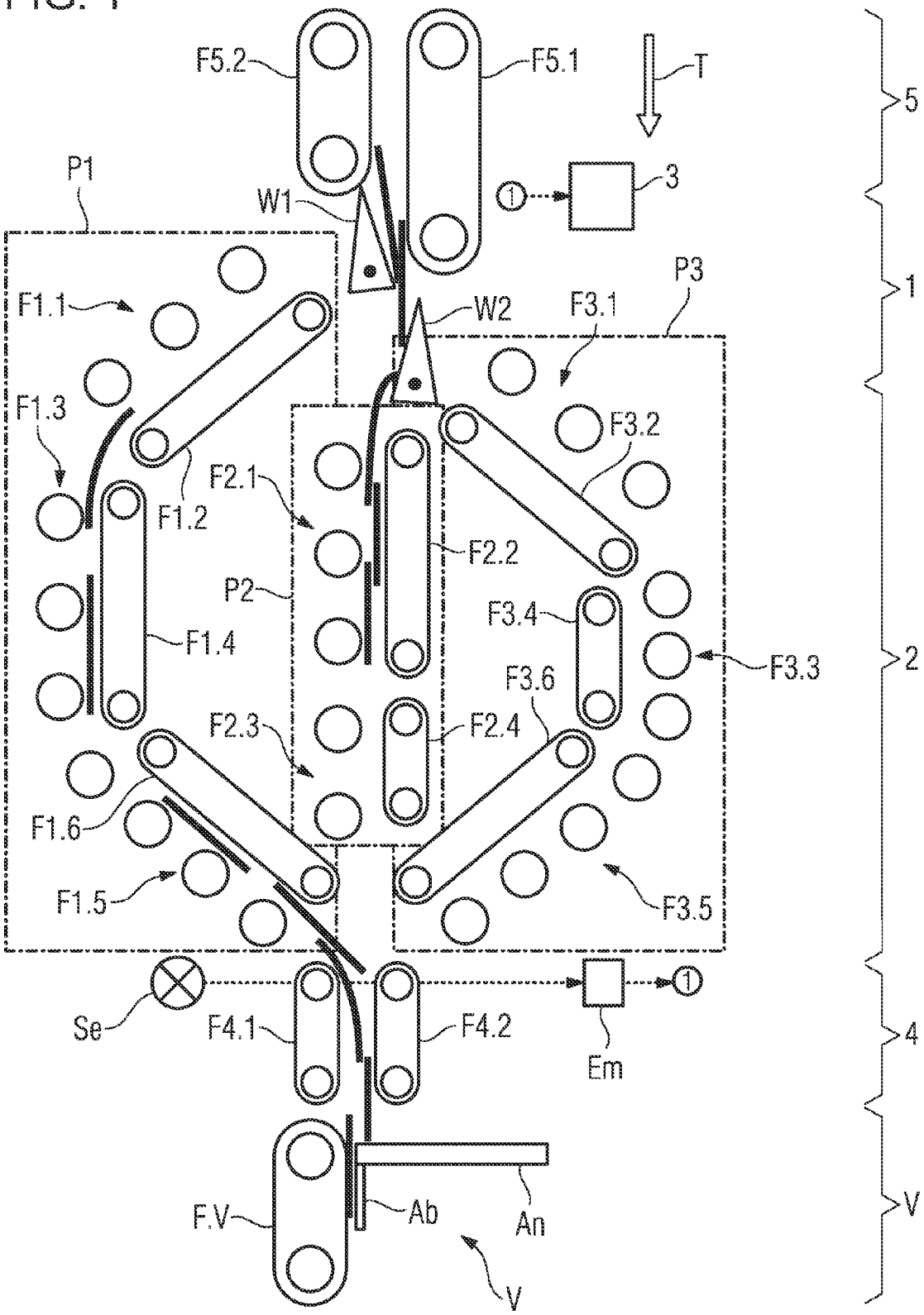
FIG. 1 is a plan view of an exemplary embodiment of a transporting apparatus according to the invention, with the first buffer section being operated in a transporting-away mode and the second buffer section in a feeding mode and with the third buffer section being in the standstill mode.

Referring now to the figures of the drawing in detail and first, particularly, to FIG. 1 thereof, there is shown a schematic illustration of the transporting apparatus of the exemplary embodiment from above. A feeder or feeding device 1, a buffer device 2, a transporting-away device 4 and a subsequent processing device in the form of a singulator V are illustrated. Items of mail are indicated by thick solid lines. The items of mail are transported in a transport direction T, i.e. from top to bottom in the illustration in FIG. 1. The transporting-away device 4 at the same time functions as a combining device, because all the buffer sections of the buffer device 2 open into this transporting-away device 4.

Once they have been aligned, the items of mail are transported in a vertically standing manner by the feeding device 5 at a feeding speed v1(t), with each item of mail being clamped during transport between in each case at least two conveying elements and being gripped by these conveying elements largely without slipping. A "conveying element" is understood in the exemplary embodiment to mean both an elastic endless conveying belt and a counterpart conveying element, for example in the form of a roller having a rough surface. Further suitable conveying elements are also appropriate.

In the example in FIG. 1, the feeding device 5 comprises two conveying elements F5.1 and F5.2 in the form of two elastic endless conveying belts, which are guided around vertical rollers.

The feeding speed v1(t) can vary over time or else be constant over time. A plurality of items of mail can be transported in an overlapping manner. The thickness of the items of mail and the throughput of items of mail through the feeding device 5 can vary over time.

The items of mail are transported by the feeding device 5 to a buffer device 2. The buffer device 2 transports the items of mail further to a transporting-away device 4, which has two conveying elements F4.1 and F4.2. The transporting-away device 4 transports the items of mail further to a processing device, which is configured as a singulator V in the exemplary embodiment. The items of mail butt against an abutment wall An and are aligned thereby at their front edges, as seen in the transport direction T. The singulator V singulates a plurality of overlapping items of mail and produces a flow of items of mail which are spaced apart from one another and are transported in an upright manner. The singulator V comprises, for example, at least two endless conveying belts, which are arranged one above the other, and a stripper Ab. One conveying belt F-V is indicated by way of example in FIG. 1.

The items of mail subsequently run through a further processing installation, for example a reading device. At the end of the sorting process, each item of mail is discharged into in each case one sorting end location, for example into an output container.

In order that the further processing installation achieves an optimum throughput, the singulator is regulated such that the items of mail leave the singulator V at a transporting-away speed v5(t). This transporting-away speed v5(t) can vary over time or be constant over time. The transporting-away speed v5(t) depends, inter alia, on the maximum achievable throughput through the singulator and the throughput through the further processing installation.

The buffer device 2 between the feeding device 5 and the processing device V makes it possible to largely decouple the feeding speed v1(t) from the transporting-away speed v5(t), even though the number of items of mail fed can vary over time.

Each item of mail runs in succession through the following devices, which are shown in part in FIG. 1:

- first of all the feeding device 5 at a speed v1(t)
- then a measuring device, preferably in the form of a light barrier,
- then an acceleration device having an acceleration section,
- then a branching device 1,
- then precisely one of a plurality of buffer sections P1, P2, P3 of the buffer device 2,
- then the transporting-away device 4 and
- then a processing device in the form of the singulator V.

The measuring device establishes the time at which an item of mail passes the measuring device. Preferably, the measuring device is configured as a light barrier. A receiver (sensor) of this light barrier registers when a light beam emitted by an emitter (light source) is interrupted by an item of mail and when it is not. Because the lengths of the items of mail transported can vary, the event that the rear edge of an item of mail passes the measuring device triggers the event that the acceleration device briefly accelerates the item of mail—or a plurality of overlapping items of mail—and as a result produces a gap to a subsequent item of mail which has not yet reached the acceleration device. The measuring device has previously measured when the front edge of the item of mail reaches the light barrier. The length of the at least one item of mail is calculated from the times at which the front edge and the rear edge reach the measuring device and it is established whether the acceleration section is long enough.

The branching device deflects each item of mail and each arrangement having a plurality of overlapping items of mail into in each case one of the buffer sections. In the exemplary embodiment, the items of mail are temporarily clamped, both in the acceleration device and in each buffer section, between in each case at least two conveying belts, and as a result are transported largely without slipping. As a result, the position of each item of mail is known at any time. Even flexible items of mail can be transported in a reliable process. It is possible for a buffer section to comprise a plurality of arrangements in succession having in each case two opposite endless conveying belts.

Each endless conveying belt is guided around a plurality of rollers which are fitted on horizontally arranged shafts. Precisely one of these rollers is driven and rotates itself and thus also the conveying belt. Preferably, each buffer section, the acceleration device, the feeding device 5 and the transporting-away device each have a separate drive. A control unit 3, here referred to as a regulator 3, is able to actuate each drive and to predetermine a respective transporting speed for this drive.

The regulator 3 receives the measured values from the light barrier and actuates the branching device. This regulator 3 logs the previous course of the transport and "knows" how many items of mail are currently in which buffer section. The regulator 3 actuates the branching device such that the branching device distributes the items of mail to the buffer sections.

In one configuration, the branching device 1 is configured as a single diverter having one inlet and three outlets. This diverter distributes the arriving items of mail at a single branching point to the three buffer sections P1, P2, P3.

In another configuration, the branching device 1 comprises, for n buffer sections, n−1 diverters in succession, each having two outlets, as is described in the above-mentioned patent application publication US 2008/0000814 A1. The two outlets of the final diverter are connected to two buffer sections. One outlet of each previous diverter is connected to the inlet of a subsequent diverter and the other outlet is connected to a buffer section. Each diverter comprises a pivotable diverter tongue, through which preferably an elastic endless conveying belt is guided, for example as is described in European patents EP 706494 B1 and EP 1133444 B1. These disclosures are herewith incorporated by reference.

In the example shown in FIG. 1, the buffer device 1 has three parallel buffer sections P1, P2 and P3. The buffer section P1 transports items of mail at a speed v2(t). The buffer section P2 transports items of mail at a speed v3(t). The buffer section P3 transports items of mail at a speed v4(t). The regulator 3 actuates the drives of these three buffer sections P1, P2 and P3 such that these speeds v2(t), v3(t), v4(t) are reached.

The first buffer section P1 comprises, in the example of FIG. 1, six conveying elements F1.1, . . . , F1.6. The three conveying elements F1.1, F1.3 and F1.5 are in the form of rollers which have, for example, a smooth surface or else a surface having a high coefficient of friction. The three other conveying elements F1.2, F1.4 and F1.6 are in the form of elastic endless conveying belts. The second buffer section P2 comprises six conveying elements F2.1, . . . , F2.6. The third buffer section P3 comprises six conveying elements F3.1, . . . , F3.6.

In the example of FIG. 1, the branching device 1 comprises two diverters W1 and W2. The preceding diverter W1—as seen in the transport direction T—diverts an item of mail either into the first buffer section P1 or leaves the item of mail on a transporting path to the following diverter W2. The following diverter W2 diverts this item of mail, depending on the diverter position, either into the second buffer section P2 or into the third buffer section P3. The vertical axes of rotation of these two diverters W1, W2 are indicated by points.

The transporting-away device 4, which at the same time functions as a combining device, can be configured as a diverter having a diverter tongue and comprises a plurality of conveying elements, which temporarily clamp the items of mail transported between one another.

In the example of FIG. 1, the transporting-away device 4 likewise comprises two elastic endless conveying belts F4.1, F4.2. These conveying belts F4.1, F4.2 are arranged such that they are able to grip an item of mail when one of the buffer sections P1, P2, P3 transports the item of mail to the transporting-away device 4, specifically no matter which buffer section does this. The transporting-away device 4 transports this item of mail to the singulator V.

The regulator 3 actuates the branching device 1 and the drives of the buffer sections such that each buffer section is driven at any one time in each case one of the following four states:

Transporting-away mode: the items of mail which are currently in the buffer section are fed to the transporting-away device (in this case the singulator V), with the speed, at which the items of mail are transported in the buffer section, depending on the predetermined transporting-away speed v5(t) but not on the feeding speed v1(t). Items of mail which are transported by the feeding device 5 are not deflected by the branching device 1 into this buffer section while the buffer section is in the transporting-away mode.

Feeding mode: the buffer section is filled with further items of mail, specifically at a transporting speed which depends on the feeding speed v1(t) but not on the transporting-away speed v5(t). While the buffer section is being operated in this feeding mode, no items of mail are transported by the buffer section to the transporting-away device 4.

Standstill mode: the buffer section is temporarily stopped and currently transports no items of mail at all, for example in order that a jam or a fault can be resolved or in order that the buffer section is available as a reserve for a large number of arriving items of mail.

The buffer section is switched from one of these modes into another mode.

In the example of FIG. 1, the first buffer section P1 is currently being operated in the transporting-away mode and items of mail are being transported out of the first buffer section P1 to the transporting-away device 4 at a speed of v2(t)=f_A[v5(t)] and subsequently to the singulator V at the same speed.

The second buffer section P2 is currently being operated in the feeding mode in the example of FIG. 1. The branching device 1 is positioned in FIG. 1 such that items of mail are directed from the feeding device 5 into the second buffer section P2. The second buffer section P2 transports items of mail at a speed v3(t)=f_Z[v1(t)], for example at v3(t)=v1(t).

The third buffer section P3 is not currently in use, i.e. the transporting speed v3(t) of the third buffer section P3 is equal to zero, and the third buffer section P3 is in the standstill mode.

The second buffer section P2 transports items of mail to the singulator at a speed v3(t). Between the items of mail and the transporting-away device 4 there is a gap which becomes smaller at v3(t). As soon as this gap becomes smaller than a predetermined limit, which may depend on v3(t), the regulator 3 automatically performs at least one of the following operations:

The regulator 3 switches the branching device 1 such that further items of mail are routed into the currently empty third buffer section P3 and switches the third buffer section P3 into the feeding mode.

The regulator 3 reduces the transporting speed v3(t) of the second buffer section P2, possibly down to a value of 0, and so the furthest forward item of mail in the second buffer section P2 only reaches the transporting-away device 4 after the first buffer section P1 has been completely emptied.

The first buffer section P1 is emptied while the second buffer section P2 is transporting items of mail to the transporting-away device 4. Further items of mail do not pass into the first buffer section P1 during the emptying process. The emptying process is carried out at the speed v2(t)=f_A[v5(t)].

Only when all of the items of mail from the first buffer section P1 have left the first buffer section P1 and have reached the transporting-away device 4 do items of mail from the second buffer section P2 follow. The regulator 3 actuates the branching device 1 such that now all the items of mail are routed either into the third buffer section p3 or into the first buffer section P1, but not into the second buffer section P2.

Now, the buffer sections P1 and P2 exchange roles: the second buffer section P2 is operated in the transporting-away mode and transports items of mail at a speed of v3(t)=f_A[v5(t)]. The first buffer section P1 is operated in the standstill mode or in the feeding mode and in the feeding mode transports items of mail at v2(t)=f_Z[v1(t)]. The third buffer section P3 is operated in the transporting-away mode or in the feeding mode.

Figure 2:
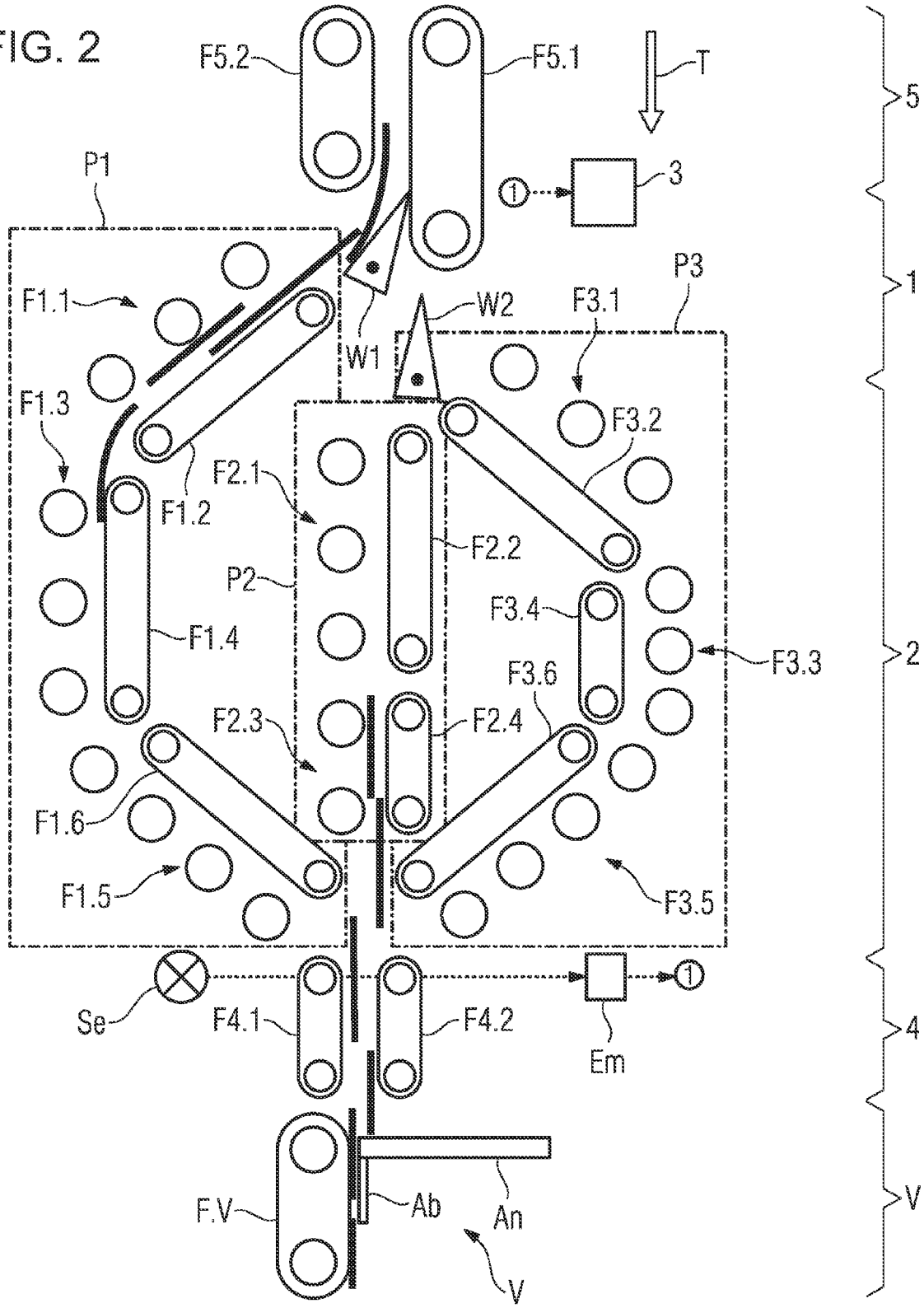
FIG. 2 shows the transporting apparatus from FIG. 1, with the first buffer section being operated in the feeding mode and the second buffer section in the transporting-away mode.

FIG. 2 shows the transporting apparatus from FIG. 1 following switching. The first buffer section P1 is operated in the feeding mode and the branching device 1 routes items of mail from the feeding device 4 into the first buffer section P1. The second buffer section P2 is operated in the transporting-away mode. The third buffer section P3 remains in the standstill mode.

In order that the branching device 1 can be switched, a gap has to arise between items of mail which are directed into a buffer section and items of mail which are subsequently directed into another buffer section. The above-described acceleration device having an acceleration section causes this gap to be produced.

Preferably, the apparatus has a sensor, which determines a jam or other fault and also determines in which buffer section this fault has occurred. The sensor then generates an appropriate fault message. The regulator 3 activates the faulty buffer section and actuates the branching device 1 such that further items of mail are directed into the other buffer sections. As a result, the apparatus can continue to be operated in spite of the fault.

The invention claimed is:

1. An apparatus for transporting articles, comprising:

a feeding device;

a buffer device having a branching device and at least two buffer sections being disposed parallel to each other relative to a transport direction; and a transporting-away device;

wherein:

each of said buffer sections connects said feeding device to said transporting-away device, said feeding device is configured to transport the articles to said buffer device, and said transporting-away device is configured to transport the articles away at a predetermined transporting-away speed;

said branching device is configured to direct each article received at said buffer device into a respective one of said buffer sections, and said buffer sections are configured to transport each respective article to said transporting-away device;

said feeding device is configured to transport the articles at a predetermined feeding speed and said transporting-away device is configured to transport the articles away at a predetermined transporting-away speed;

a regulator connected to and configured to actuate said branching device and said buffer sections such that each buffer section is in at least one of the following modes:

a feeding mode of said buffer section, wherein said branching device directs an article transported to said buffer device into said buffer section and said buffer section transports each article in said buffer section, in direction, to said transporting-away device at a feeding buffer speed that depends on the feeding speed;

a transporting-away mode of said buffer section, wherein said buffer section transports each article in said buffer section to said transporting-away device at a transporting-away buffer speed that depends on the transporting-away speed; and said regulator further being configured to actuate each said buffer section such that:

each buffer section is at any one time in at most one of the feeding or transporting away modes or a third mode;

there is a gap present between an article that is farthest forward, in the transport direction, in said buffer section and said transporting-away device while the said buffer section is in the feeding mode; and said regulator switching the said buffer section into another mode in such a way that the said buffer section is in the other mode before the article that is farthest forward reaches said transporting-away device.

2. The apparatus according to claim 1, wherein said regulator is additionally configured to switch a respective said buffer section into a standstill mode, and said buffer section is deactivated in the standstill mode and an article that is present in said buffer section is not transported by said buffer section.

3. The apparatus according to claim 2, which further comprises a sensor disposed to monitor a filling level of the transporting-away device and to output a signal to said regulator, wherein said regulator is additionally configured to:

switch said buffer section from the feeding mode into the standstill mode if a signal received from said sensor is a "filled" signal; and switch said buffer section into the transporting-away mode if the "filled" signal is not present or is no longer present.

4. The apparatus according to claim 1, wherein at most one of said buffer sections is in the feeding mode at any one time, and said branching device is configured to direct any article reaching said branching device during this time into the respective said buffer section.

5. The apparatus according to claim 1, wherein at most one of said buffer sections is in the transporting-away mode at any one time, and any article reaching said transporting-away device during this time is transported to said transporting-away device by the respective said buffer section.

6. The apparatus according to claim 1, which said regulator is additionally configured to actuate said branching device and each buffer section such that, when a given buffer section is in the transporting-away mode, said branching device directs articles from said feeding device into a different buffer section.

7. The apparatus according to claim 1, wherein a gap in a given said buffer section that is in the feeding mode is reduced by the transport of the articles in said buffer section, and said regulator is configured to switch the given said buffer section into the other mode in the event that the gap becomes smaller than a predetermined threshold.

8. The apparatus according to claim 1, wherein said regulator is additionally configured:

to switch a given said buffer section that is currently in the feeding mode into another mode in such a way that a gap is produced between a rearmost article, as seen in the transport direction, in said buffer section and said branching device, before said buffer section is switched into the other mode.

9. The apparatus according to claim 1, wherein said regulator is additionally configured:

when a given said buffer section is in the feeding mode, first of all to actuate said branching device in such a way that said branching device directs further articles into a different buffer section; and then to switch said buffer section into the one other mode.

10. The apparatus according to claim 1, wherein said regulator is additionally configured to switch a given buffer section that is currently in the transporting-away mode into another mode only once the given said buffer section has transported all the articles in said buffer section to the transporting-away device and has thus been emptied.

11. The apparatus according to claim 1, wherein said regulator is additionally configured, when a first buffer section is in the feeding mode and a second buffer section is in another mode:

to switch said first buffer section into another mode and said second buffer section into the feeding mode, so that following switching the first buffer section is in the other mode and the second buffer section is in the feeding mode; and to actuate said branching device such that said branching device transports articles into the second buffer section once the two buffer sections have been switched.

12. The apparatus according to claim 1, which further comprises an acceleration device disposed between said feeding device and said branching device and configured to transport articles to said branching device and to accelerate the articles in the process, and said regulator is additionally configured:

to actuate said acceleration device such that said acceleration device produces a gap between the articles in said acceleration device and following articles in said feeding device; and to switch said branching device once the accelerated articles have reached said branching device and before the following articles have reached said branching device.

13. The apparatus according to claim 1, wherein each buffer section comprises at least two conveying elements and is configured to temporarily clamp an article between said at least two conveying elements during transport and to transport the article.

14. A method for transporting articles, the method which comprises:

providing a transport system including a feeding device, a transporting-away device, and a buffer device with at least two buffer sections;

transporting the articles with the feeding device to the buffer device at a given feeding speed;

directing each article transported to the buffer device into in each case one of the buffer sections;

transporting the respective articles with the buffer section to a transporting-away device;

transporting the articles away with the transporting-away device at a given transporting-away speed;

operating each buffer section in a feeding mode or in a transporting-away mode, or in a third mode and wherein:

when a buffer section is in the feeding mode, an article transported to the buffer device is directed into the buffer section and the buffer section transports any article located in the buffer section, in direction, to the transporting-away device at a feeding buffer speed that depends on the feeding speed; and when a buffer section is in the transporting-away mode, the buffer section transports any article located in the buffer section to the transporting-away device at a transporting-away buffer speed that depends on the transporting-away speed;

each of the buffer sections is, at any one time, in at most one of the feeding mode or the transporting-away mode or the third mode; and transporting the articles, with a given buffer section in the feeding mode, such that there is a gap between a forward-most article, as seen in the transport direction, in the buffer section and the transporting-away device while the given buffer section is in the feeding mode; and switching the buffer section into another mode such that the buffer section is in the other mode before the forward-most article reaches the transporting-away device.

15. The method according to claim 14, which comprises:

transporting a first article and a subsequent second article spaced apart therefrom with the feeding device to the buffer device at least once;

directing the first article into a first buffer section, which is in the feeding mode;

switching the first buffer section into another mode;

directing the subsequent second article into a second buffer section, which is different from the first buffer section and which is in the feeding mode; and thereby switching the first buffer section into the other mode before the second article is directed into the second buffer section.

16. The method according to claim 14, which comprises directing each article only into a buffer section that is in the feeding mode when the article reaches the buffer section.

17. The method according to claim 14, which comprises:

maintaining a given buffer section that is in the transporting-away mode in the transporting-away mode, until the given buffer section has transported away all articles located in the given buffer section to the transporting-away device and has been emptied; and subsequently switching the given buffer section into another mode.

* * * * *